United States Patent [19]

Heide et al.

[11] Patent Number: 4,840,178

[45] Date of Patent: Jun. 20, 1989

[54] MAGNET FOR INSTALLATION IN THE MIDDLE EAR

[75] Inventors: Jorgen Heide, Cordoba; Timothy D. Gooch, Memphis; Anthony D. Prescott, Arlington, all of Tenn.; Dennis Bojrab, Bloomfield Hills, Mich.

[73] Assignee: Richards Metal Company, Memphis, Tenn.

[21] Appl. No.: 50,940

[22] Filed: May 15, 1987

Related U.S. Application Data

[63] Continuation-in-part of Ser. No. 837,708, Mar. 7, 1986.

[51] Int. Cl.[4] ..... H04R 25/00

[52] U.S. Cl. ..... 128/419 R; 381/68.3

[58] Field of Search ..... 128/419 R, 420.5, 420.6; 381/68.3

[56] References Cited

U.S. PATENT DOCUMENTS

| | | | |
|---|---|---|---|
| 3,710,399 | 1/1973 | Hurst . | |
| 3,870,832 | 3/1975 | Fredrickson | 179/107 E |
| 4,606,329 | 8/1986 | Hough | 128/1 R |
| 4,628,907 | 12/1986 | Epley | 381/68.3 |

*Primary Examiner*—Maryann Lastova

*Attorney, Agent, or Firm*—Pravel, Gambrell, Hewitt, Kimball & Krieger

[57] ABSTRACT

A magnet assembly for location around portions of bones in the middle ear where one portion of the assembly is a magnet and another portion of the assembly is a magnetic material, the portions being hinged to one another so that they are held around the bone by the magnetic field and being adapted for optimal coupling with a magnetic field produced by a coil in a magnetic induction hearing aid.

7 Claims, 6 Drawing Sheets

MAGNET FOR INSTALLATION IN THE MIDDLE EAR

This application is a continuation-in-part of copending application, Ser. No. 837,708, filed Mar. 7, 1986.

BACKGROUND OF THE INVENTION

1. Field of the Invention

The present invention relates to hearing aids and, more particularly, to a hearing aid using magnetic induction to reproduce sound.

2. Description of the Prior Art

Hearing aids are useful in restoring lost aural perception to those persons having mild to severe loss of hearing. Conventional hearing aids have a microphone, amplifier circuitry, a battery and a speaker. The microphone receives the sound energy and transforms the sound energy into an electrical signal which is then amplified and filtered. This amplified signal is transformed back to acoustic energy by the speaker and transmitted to the person's middle ear for perception of the sound. These hearing aids can be placed behind the ear, with only the receiver being placed inside the ear canal. Alternatively, in-the-ear hearing aids are available which are placed in the outer ear and have portions extending into the ear canal.

There are a number of problems with conventional hearing aids. All conventional hearing aids are visible to some extent and therefore have an undesirable cosmetic appearance. Conventional hearing aids have acoustic feedback problems because sound energy can escape from the ear canal and be detected by the microphone, generating a feedback-related whistle. Additionally, sound reproduction is often lacking in clarity because of distortions generated by standing waves existing in the closed cavity between the hearing aid and the tympanic membrane and poor mechanical reproduction by the speaker.

It has been suggested that a magnetic induction hearing aid would remove many of these problems. A magnet or other item having a magnetic field is placed in the middle ear, either in contact with the tympanic membrane or in contact with other portions of the middle ear. Electrical circuitry and a coil would generate a magnetic field having the same frequency as the external sound. The magnetic field generated by the coil would interact with the field of the magnet and cause the magnet to vibrate at the same frequency as the magnetic field. The vibration of the magnet would then cause the attached portion of the middle ear to vibrate, resulting in a perception of the external sound.

A magnetic induction hearing aid would overcome feedback or distortion problems of conventional hearing aids because there would be no significant air movement in the ear canal, resulting in insufficient energy escaping around the hearing aid to generate a feedback problem. There would be no standing waves generated to cause distortion because there are no appreciable sound waves at all.

Attempts to use magnetic induction hearing aids have been reported. An early attempt placed a coil in conjunction with a small piece of iron on the tympanic membrane, which was excited by an external coil placed over the ear canal. This system did allow the perception of the stimulus, but had the side effect of producing discomfort and pain for the wearer. A later attempt glued a small magnet to the umbo and used an external coil placed over the ear of the wearer to cause the sympathetic vibrations of the magnet. This apparatus required approximately 7.9 ma to produce a 0 db hearing level at 1000 Hz.

In an article entitled *Audition via Electromagnetic Induction,* Arch Otolaryngol 23 (July 1973), Goode et al describe a number of tests. One test attached a magnet to the tympanic membrane and located a coil in the ear canal 3 mm from the magnet. The coil was driven externally by an audiometer. This development required only 0.7 ma to produce a 0 db hearing level at 1000 Hz. Tests were performed for system fidelity and proved adequate. Another system tested placed the coil over the ear, drove the coil with an audiometer and had a magnet glued to portions of the middle ear, but used larger magnets than in previous tests. One version of this system placed the magnet on a Silverstein malleus clip which was connected in the normal manner. Approximately 0.7 ma was required to produce a 0 db hearing level using these arrangements.

These discussions suggested that the use of electromagnetic induction to produce a hearing aid is possible, but did not teach a way to develop a practical system. The majority of tests used coils placed over the ear or adjacent to the ear. Systems using external coils are not efficient enough for use in conjunction with the low power requirements dictated by hearing aid batteries. Although one test indicated that a coil was placed inside the ear canal, an external amplifier was used to drive the coil. The tests did not result in a practical device or suggest how a totally in-the-ear device could be made.

Further, the magnets described in conjunction with the above-mentioned tests were either glued to portions of the middle ear and removed after short periods of time or were connected to malleus clip and inserted for a longer duration. Neither of these attempts resulted in a magnet that could be implanted for extended periods of time with no danger of rejection by the body, have no movement in relation to the middle ear and yet have as little weight as possible.

SUMMARY OF THE INVENTION

The present invention is directed to a magnetic induction, in-the-ear hearing aid where all the elements of the hearing aid are placed within the ear canal and the middle ear. A microphone, amplifying electronics, battery and driving coil are placed within a single housing which is custom molded for each wearer and placed deep within the ear canal.

The amplifier is one of two types, either Class A or Class B, depending on volume levels required. The coils are matched to the particular amplifier type to provide optimal efficiency for a given design. The coil is formed of a number of turns of wire wound over a mumetal core, which is used to increase magnetic field strength. The coil is placed close to the magnet to allow optimal coupling of the magnet's field with the magnetic field produced by the coil.

The magnet is formed of a neodymium-iron material allowing a very high strength magnetic field to be developed by a very small magnet. Since this material corrodes when placed in an animal body, it is coated with a biocompatible material.

The magnet is formed of a neodymium-iron material allowing a very high strength magnetic field to be developed by a very small magnet. Since this material corrodes when placed in an animal body, it is coated with a biocompatible material.

The magnet can be installed around the incus or other bone in the middle ear. The incus is a location which is easily accessible in individuals having undamaged physical middle ear structures and is located close to the tympanic membrane so that efficient magnetic coupling can occur between the magnet and the coil of the hearing aid.

The magnet is preferably a two piece magnetic structure hinged at one end so that the structure can be opened for placement around the incus and then is self closing without need for crimping or bending of wires or use of other materials. One piece of the assembly is comprised of a magnet, preferably, samarium cobalt, while the other piece is comprised of magnetic material. This magnetic material can be paramagnetic, ferromagnetic or can be an actual magnet. The magnet is coated with biocompatible materials to prevent corrosion or other adverse body reactions.

The hinge between the two components can be a separate hinge or can be a pivoting structure formed by the interaction of the two pieces. The structure is self closing in that an open gap exists on the side opposite the hinge after the structure has been placed around the incus. The existence of the gap causes the pieces that form the structure to continually try to move together because of the magnetic attraction that exists in the open gap of the structure. This allows portions of the bone to diminish in size and yet have the magnet continue to remain firmly affixed without need for further attention by a physician. The magnet is adapted for optimal shape for coupling with the field produced by the magnetic coil of the hearing aid, thereby increasing the efficiency and battery life of the hearing aid.

BRIEF DESCRIPTION OF THE DRAWINGS

A better understanding of the invention can be obtained when the detailed exemplary embodiment set forth below is considered in conjunction with the following drawings, in which.

DETAILED DESCRIPTION OF EXEMPLARY EMBODIMENTS

Figure 1:
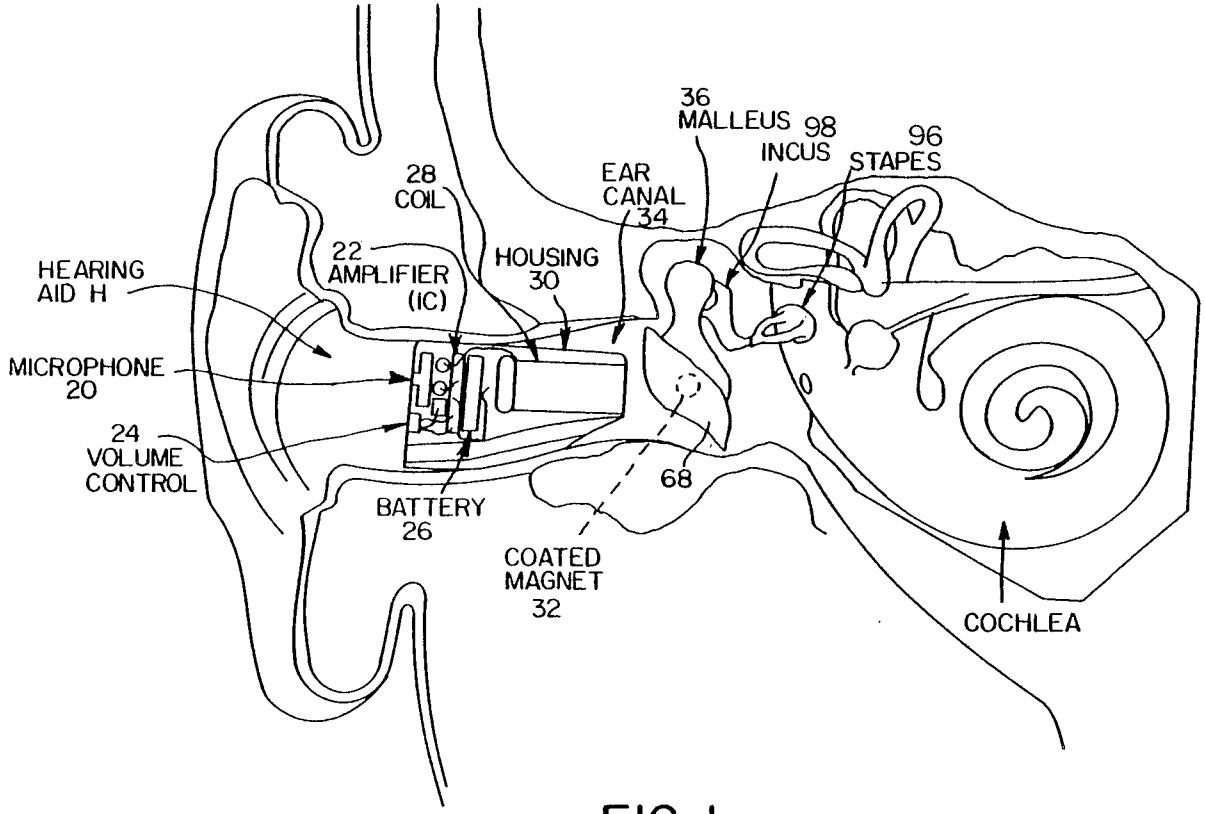
FIG. 1 is a cross-sectional view of a human ear with a magnetic induction hearing aid according to the present invention placed in the ear canal.

Referring to FIG. 1, the letter H refers generally to a hearing aid according to the present invention and is shown installed in an ear canal 34. The hearing aid H has a housing 30 enclosing a microphone 20, an amplifier 22, a volume control 24, a battery 26 and a coil 28. The hearing aid H is located deep in the ear canal 34 so that the coil 28 is located near a coated magnet 32, with 2.5 mm being a desirable distance for this separation. This distance is sufficiently close to reduce the inverse relationship of distance to magnetic field strength and yet is sufficiently far that the hearing aid H can be inserted by the wearer with minimal difficulty and not be in danger of contacting the tympanic membrane 68.

The installation of the hearing aid H deep within the ear canal 34 as shown in FIG. 1 eliminates any negative cosmetic effects of a hearing aid because the hearing aid H is practically undetectable. A conventional hearing aid cannot be inserted this deep in the ear canal 34 because of the standing wave and feedback problems discussed above. These problems do not occur in a magnetic induction hearing aid and therefore this deep placement is possible.

Volume adjustment and battery replacement is accomplished by removing hearing aid H from the ear canal 34, appropriately adjusting the volume control 24 or replacing the battery 26 and reinserting the hearing aid H into the position shown in FIG. 1.

The housing 30 is custom molded to each wearer's ear canal 34. This is necessary because each wearer has a differently sized and shaped ear canal. The hearing aid H must be sufficiently close to the magnet 32 for proper operation and the hearing aid H must be sufficiently tight within the ear canal 34 to remain in place during normal use.

Figure 2:
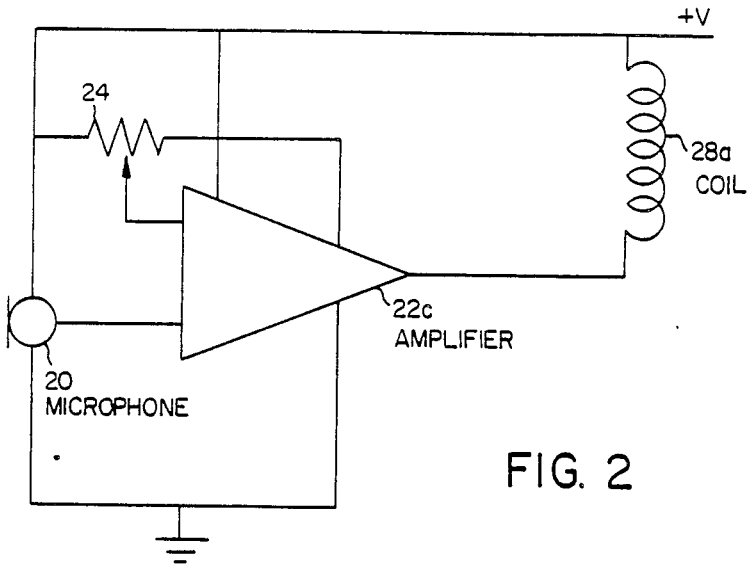
FIG. 2 is an electrical schematic diagram of one embodiment of a circuit utilizing a Class A amplifier designed according to the present invention.

A class A amplifier design is shown in FIG. 2. The microphone 20 is a standard electret microphone as conventionally used in hearing aids. The amplifier 22*c* is class A design that is standard in hearing aid applications. This amplifier is specifically designed for low voltage operation in conjunction with a single 1.3 volt battery. The volume control 24 is connected to vary the gain of the amplifier 22*c* and thereby change the output signal level applied to the coil 28*a*. The coil 28*a* is designed for use with the class A amplifier 22*c*.

Figure 8A:
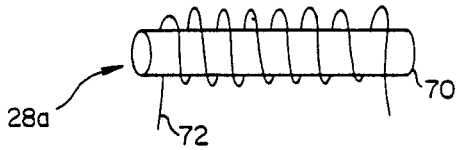
FIGS. 8*a*, 8*b* and 8*c* are schematic illustrations of coils formed according to the present invention.

Each amplifier used in hearing aids has a recommended output load impedance which is normally deemed to be the speaker or receiver impedance. For optimum performance of the hearing aid H, the coil 28*a* should be designed to match this characteristic desired impedance across as wide a frequency band as possible. The coil 28*a* is a double-ended coil designed to be connected to the battery 26 and to the output of the amplifier 22*c*. The coil 28*a* is formed by winding the appropriate number of turns of wire 72 (FIG. 8*a*) about a high permeability core 70. Preferably, the core 70 is comprised of mumetal to increase the magnetic field strength at the ends of the coil. The maximum coil size is preferably approximately 9 mm long and 4 mm in diameter. This size limitation is used in conjunction with the optimum coil impedance in determining the number of turns of wire 72 and the gauge of the wire 72 to produce a coil of the allowed size having the desired impedance.

The class A amplifier 22*c* is used in situations where the wearer has only a mild to moderate loss of hearing.

Figure 3:
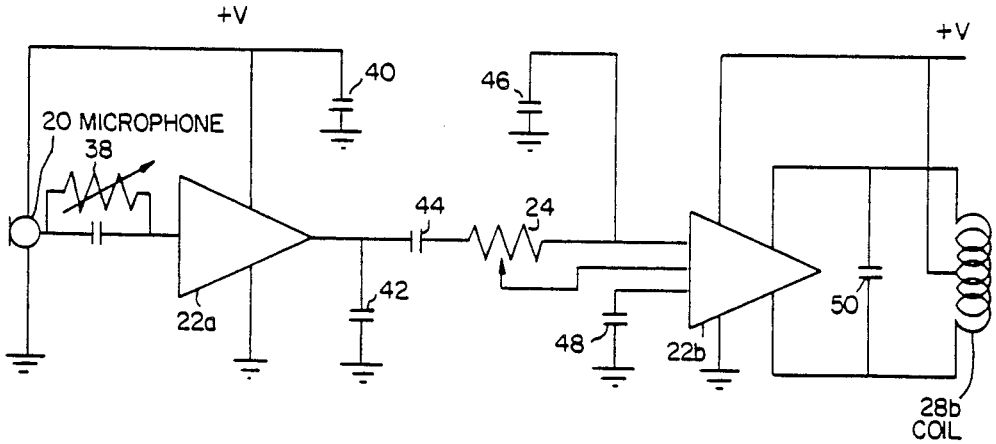
FIG. 3 is an electrical schematic diagram of a second embodiment of a circuit utilizing a Class B amplifier designed according to the present invention.

The class A design is used in the mild loss case because the power consumption of the class A amplifier 22c is lower, but the maximum output is also lower, necessitating a higher performance or class B design for high power needs.

Where the wearer has a more severe hearing loss requiring greater amplification of the sound signal, what is known as a class B amplifier design as shown in FIG. 3 is used. A class B amplifier 22b is used in the higher volume, higher amplification situations because it has a power output level higher than that of the class A amplifier 22c. The trade off for this efficiency is reduced battery life because of the higher current draw of the class B amplifier design.

Figure 8B:
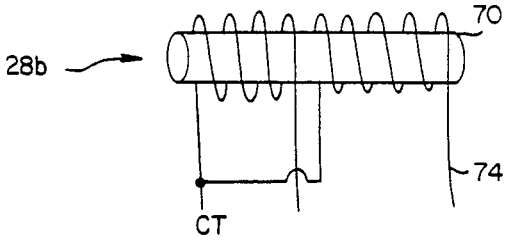
Figure 8C:
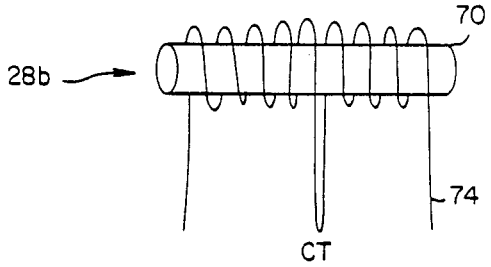

The microphone 20 is connected to a preamplifier stage 22a through an impedance matching and filter stage 38. The class A preamplifier 22a provides a fixed amount of gain and produces an output signal which is transmitted to filter capacitors 42 and 44 and the volume control 24. Appropriately adjusting the volume control 24 changes the output voltage of the class B output amplifier 22b which in turn drives coil 28b. As in the class A amplifier 22c, the class B output amplifier 22b has an optimal load impedance resistance which is specified by the manufacturer. The coil 28b is designed to have an impedance which matches this optimal impedance over as broad a frequency band as is necessary for the given application. The coil 28b is designed with a center tap (FIGS. 8b and 8c) to allow use with the class B amplifier 22b. An appropriate number of turns of the appropriate gauge wire 74 are wound around the mu-metal core 70 or other high permeability material and connected as required to the amplifier 22b. The class B amplifier 22b produces greater power because of its class B design and its push-pull operation, enabling the coil 28b to produce larger magnetic field densities and thereby move the magnet 32 a greater distance.

Figure 7:
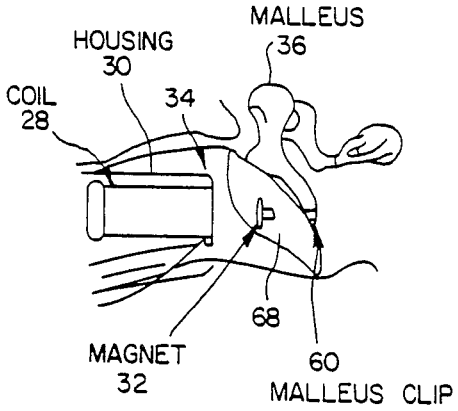
FIG. 7 is a cross-sectional view of an eardrum or tympanic membrane and malleus in which a magnet mounted to a malleus clip is connected to the malleus.
Figure 5C:
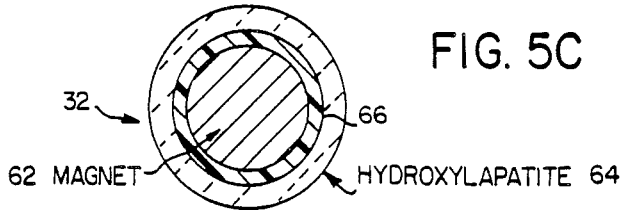
FIGS. 5*a*, 5*b*, 5*c* and 5*d* are, respectively, cross-sectional top and side views of a magnets formed according to the present invention.
Figure 5D:
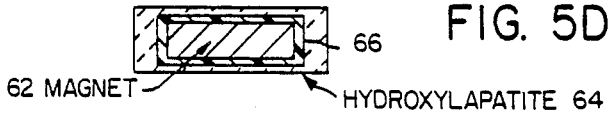
Figure 6:
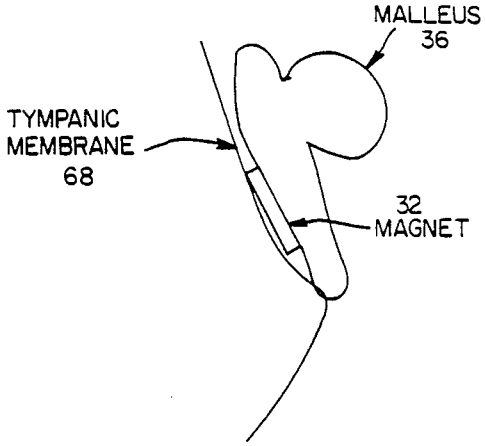
FIG. 6 is a partial cross-sectional view of a middle ear showing an magnet implanted according to the present invention.
Figure 5A:
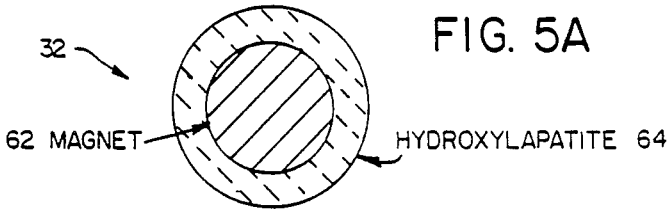
Figure 5B:
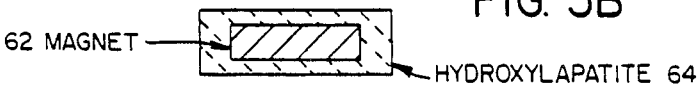

The coil 28 produces a magnetic field varying at the frequency of the sound waves received by the microphone 20. The coil's magnetic field then interacts with the magnet 32. A sympathetic vibration of the magnet 32 occurs at the frequency of the sound waves. This mechanical vibration of the magnet 32 is then translated into movement of either the malleus 36 if the magnet 32 is attached to a malleus clip 60 (FIG. 7) or to vibration of the malleus 36 and the tympanic membrane 68 if the magnet 32 is inserted between the malleus 36 and the tympanic membrane 68 as shown in FIG. 6.

It is desirable that the coil 28 be placed in close proximity to the magnet 32 because a magnetic field decreases with strength according to the inverse cube law. Therefore, the coil's magnetic field effecting and interacting with the magnet 32 is radically diminished as the separation distance increases. This diminishing interaction directly effects the efficiency of the hearing aid H and therefore a minimum gap is desirable.

If the magnet 32 is implanted behind the tympanic membrane 68, the magnet 32 can move by either of two actions. The first movement is a piston-type action perpendicular to the plane of the membrane 68. The second action of the magnet 32 is a rocking action about a horizontal axis of the magnet 32. This rocking does cause the tympanic membrane 68 and the malleus 36 to vibrate, creating a sensation of sound. The rocking action is preferable because there is better magnetic coupling between the magnet 32 and the coil field, which increases effective acoustic gain and thereby system efficiency.

The mass of the magnet 32 must be kept at a minimum to further increase the efficiency of the design so that the coil's magnetic field does not have to oscillate a large mass and thereof require additional energy transfer between the coil 28 and the magnet 32. But the magnet 32 must also be high strength so that the two interacting magnetic fields, the coil field and the magnet field, are sufficiently strong to create a sufficient amount of coupling between the two fields. For this reason it is preferable that the magnet 32 be formed from the neodymium-iron which has an extremely high field strength for a given magnet size.

Because the magnet 32 is to be inserted in the human body it is necessary that the magnet 32 or magnet assembly be biocompatible and not corrode or cause adverse tissue reaction when placed in the body. It is also desirable that the magnet become firmly and permanently attached to the desired portions of the middle ear.

The preferred neodymium-iron magnet, in and of itself, does not meet these requirements. It corrodes when placed in the body and therefore is not suitable in its uncoated state for long-term placement or installation. Therefore, for biocompatibility the magnet 32 must be coated and sealed with a biocompatible material. There are two alternative versions of the coated magnet 32, one for use with the malleus clip 60 and the other for direct implantation between the tympanic membrane 68 and the malleus 36.

Figure 4:
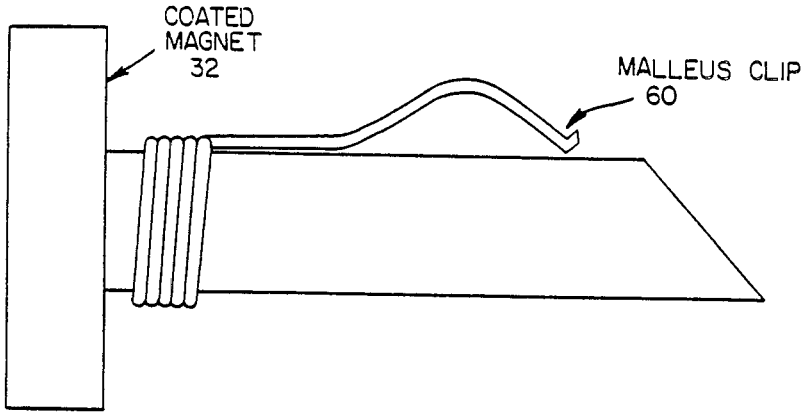
FIG. 4 is a side view of a malleus clip having a magnet mounted thereon.

The magnet 32 that is attached to the malleus clip 60 (FIG. 4) need only be biocompatible to the degree that it does not produce an infection and does not corrode. For this use, a coating of the magnet with biocompatible materials such as gold or other nonresorbable, biocompatible material such as various commonly available polymers is necessary. No actual mechanical bonding between the magnet 32 and portions of the middle ear is necessary because the malleus clip 60 provides the connection with the malleus 36 and the magnet 32 is firmly mounted on the malleus clip 60.

For the embodiment of the magnet 32 to be used for direct implantation between the tympanic membrane 68 and the malleus 36, different criteria must be considered. It is highly desirable that this magnet 32 be coated with a bioactive material which will form a permanent bond with the middle ear. To this end it is preferable that the magnet 62 (FIGS. 5a, 5b, 5c, 5d) be coated with hydroxyapatite 64. Hydroxyapatite is a calcium phosphate material which has a particular crystal structure which resists biodeterioration and has an outer surface that easily adheres to tissue that is generated by the adjacent body portion.

Hydroxyapatite is preferred as the material that is useable as an outer coating material, but other nonresorbable bioactive materials could be used. Hydroxyapatite is referred to in this specification because it is the currently preferred material and these references to hydroxyapatite are intended to include other similar materials. Coating the magnet 62 with hydroxyapatite 64 and placing the coated magnet 32 between the tympanic membrane 68 and the malleus 36 results in the magnet 32 becoming part of the middle ear after a period of time due growth of middle ear tissue and its adherence to the hydroxyapatite coating 64.

A coating of hydroxyapatite 64 over a bare magnet 62 might possible by satisfactory if the magnet were sealed from surounding body fluids. However, because a neodymium-iron magnet is highly corrodable in an animal body and a complete seal is difficult to achieve, the magnet 62 first receive a precoating 66 prior to the final coating of hydroxyapatite 64. This precoating 66 is used to seal the magnet 62 from the bodily environment and therefore resist corrosion. The sealant can be a biocompatible material such as gold or other biocompatible polymers as are used in implantable medical devices. the precoated magnet is then coated with the hydroxyapatite 64 or other nonresorbable bioactive materials with similar properties.

There are several different processes that could be used for applying the hydroxyapatite coating. The first process is an ion implantation or sputtering technique wherein the target magnet is placed inside a vacuum chamber and positioned near a hydroxyapatite source. The hydroxyapatite source is then bombarded by an electron beam source from an ion accelerator so that the hydroxyapatite atoms are stripped from the source material and attracted to the target material due to electrostatic forces. Alternatively, a hydroxapatite plasma can be produced by a radio frequency power source and directed toward the target material. The charged hydroxyapatite atoms are then driven into the magent 62 or the precoat 66 by means of an accelerated argon ion beam. This firmly implants the hydroxyapatite atoms into the magnet 62 or precoat 66 forming a firm bond between the two layers. This process is continued until a sufficient hydroxyapatite coating thickness is produced, preferably about one micron.

The ion implantation process in a low temperature process which allows the magnet 62 retain its magnetism. If the magnet 62 is subjected to a sufficiently high temperature, it loses its magnetism and therefore is rendered unusable. For this reason, the target must be kept at a low temperature which is capable of being done in the ion implantaion or sputtering technique.

A low temperature process is also important so that the hydroxyapatite source material retains its preferred hydroxyapatite structure. If the materials forming the hydroxyapatite are elevated to a sufficiently high temperature, the hydroxyapatite converts to tricalcium-phosphate which is a bioresorbable material and is not satisfactory for coating the magnet 62. This is because the material is resorbed by the body and would eventually disappear from the magnet 62, leaving the magnet 62 uncoated and not bonded as desired. Therefore the low temperature ion implantation technique allows the hydroxyapatite 64 to keep its structure after being sputtered to the target magnet.

A second process for coating the precoated magnet is a plasma spraying technique. In this process the hydroxyapatite 64 is in the form of a powder and is fed through an argon plasma which melts the hydroxyapatite powder which is then fired onto the surface of the target magnet. The hydroxyapatite 64 then cools down, solidifies and is bonded to the precoating material 66. In this process it is possible to keep the substrate or target material temperature sufficiently low so as not to demagnetize the magnet 62.

A third process for applying the hydroxyapatite coating material involves placing the hydroxyapatite material on the surface of the polymer used as the precoat 66 before the polymer precoating material is fully solidified. When the biocompatible precoating polymer material 66 is applied to the magnet 62 in a molten form there is an interval wherein the precoating material 66 is sufficiently adhered to the magnet 62 and yet is not completely solidified. During this tacky or partially fluid state, the hydroxyapatite material is introduced onto the magnet assembly and physically pressed into the precoating material 66, therefore bonding with the precoating material 66 which then completes its hardening process. In this way, the hydroxyapatite material 64 has fully interlaced with the precoating polymer 66 which is firmly attached and sealing the magnet 62. An intermediate biocompatible coating attached to the underlying precoating material 66 can also be used to bond the hydroxyapatite 64 to the magnet 62.

Figure 10:
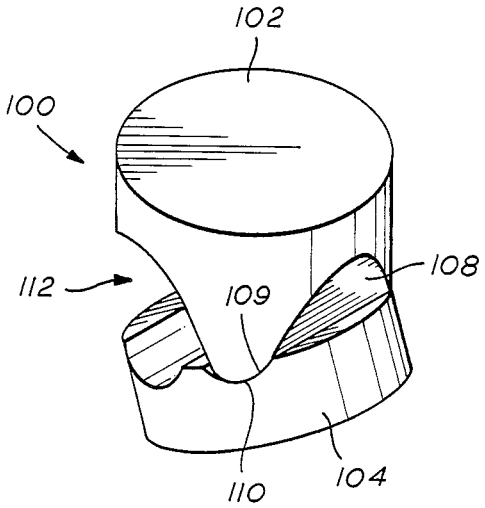
FIG. 10 is a perspective view of the magnet of FIG. 9.
Figure 11:
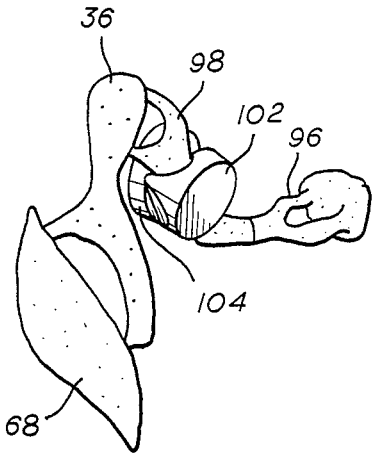
FIG. 11 is a partial cross-sectional view of a middle ear showing a magnet implanted according to the present invention.

Alternatively, the magnet used with the hearing aid H can be located around the incus 98 (FIG. 11). In this preferred embodiment, the magnet 100 (FIGS. 9 and 10) is formed of two pieces which are hinged together. A first piece 102 is generally cylindrical in shape and has a transverse groove 106 located in the interior face 105 of the piece 102. The groove 106 is adapted to contact a portion of the incus 98 when the magnet 100 has been placed around the incus 98. The first piece 102 also contains a pivot section or fulcrum 108 which extends from the general body of the pivot piece 102 and has a rounded cross-section 109 at its end. A second or mating piece 104 is also generally cylindrical in shape and also contains a transverse groove 106 adapted for mating with the incus 98. The second structure 104 contains a second, generally smaller, transverse groove 110 adapted to cooperate with the pivot section 108 such that when pivot section 108 is located in the groove 110, the pieces 102, 104 are hinged at this location through their magnetic attraction and pivot in relationship to each other.

Figure 9:
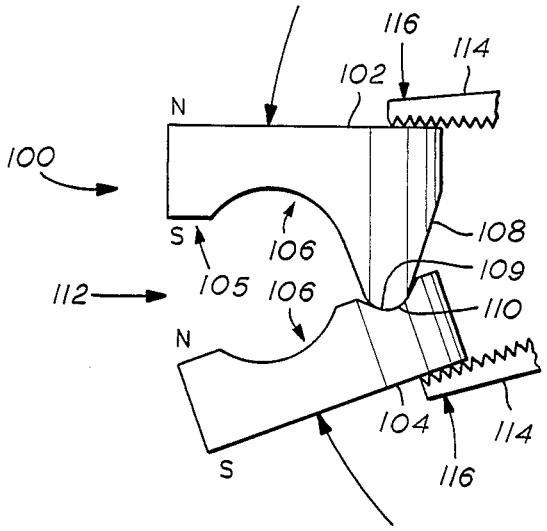
FIG. 9 is a side view of a magnet according to the present invention.

Preferably, both of the pieces 102 and 104 are magnets having poles as shown in FIG. 9. Alternatively, only one of the elements 102 or 104 need be a magnet. The other piece can be a magnetic material, either paramagnetic or ferromagnetic, such that the material is a good concentrator of magnetic flux lines. If the magnetic material is a permanent magnet, the entire magnet assembly 100 has a greater magnetic field than if one piece is paramagnetic or ferromagnetic, thereby increasing the efficiency and battery life of the hearing aid.

The pivot section or fulcrum 108 is further adapted such that the pieces 102, 104 have a gap 112 when attached to the incus 98. This gap 112 results in a self-closing feature of the magnet 100 because the magnet 100 will have a tendency to try to reduce this gap so as to concentrate the magnetic flux. This self-closing allows the magnet 100 to remain in contact with the incus 98 even if the incus 98 reduces in diameter as a result of tissue resorption because of the pressure caused by the attraction between the two pieces 102, 104. Preferably the gap 112 will completely close and the pieces 102, 104 will come into contact before the incus 98 has eroded too far. When the gap 112 is closed, tissue resorption stops and the magnet 100 then remains locked onto the incus 98.

The magnet 100 is preferably made of samarium cobalt, but can be made of neodymium-iron or other magnet materials. In the preferred embodiment, the pieces 102, 104 have a diameter of 0.090" and a thickness of 0.030". The incus grooves 106 have a preferable radius of 0.025", a depth of 0.010" and are 0.040" wide at the piece face. The pivot section 108 is preferably 0.038" long and the pivot groove 110 has a radius of 0.007", a width of 0.021" at the piece face and a depth of 0.008". The magnet 100 is coated with a biocompatible polymer to prevent corrosion of the magnet, to prevent rejection of the material by the body and to allow ingrowth of tissues if desired.

The geometrical proportions and alignment of the magnet 100 are such that the pole faces are oriented with the magnetic field produced by the coil 28 in the magnetic hearing aid H to achieve maximum coupling of the magnetic fields.

The magnet assembly 100 can be adapted to be placed in other portions of the middle ear other than the incus 98, including the malleus 36 and the stapes 96, with appropriate design of the pieces 102, 104 for optimal coupling of the magnetic fields given the magnet 100 location, and for hinge and groove dimensions and location given the geometry of the portion of the middle ear to which the magnet 100 is being attached.

Preferably the magnet 100 is designed to be mounted on the incus 98 because this location is the closest, most easily accessible location relative to the tympanic membrane 68 and allows the use of basic configurations of the magnet 100 for magnetic field coupling. The magnet 100 is implanted by grasping the magnet 100 with forceps 114 (see FIG. 9) on the sides 116 of the pieces 102, 104 away from the incus grooves 106, causing the magnet 100 to pivot open. The opened magnet 100 is then inserted through an incision formed in the tympanic membrane 68 until it reaches the incus 98, at which time the magnet 100 is allowed to close over and clamp onto the incus 98. The magnet 100 aligns itself with the incus grooves 106 centering on the incus 98. When the magnet 100 closes, it is firmly attached to the incus 98.

While the pieces 102, 104 that form the magnet 100 are shown in FIGS. 9–11 as hinged through their magnetic attraction to each other, alternative embodiments with mechanical hinges using pins or the like could be used in accordance with the invention. Although forceps 114 can easily grasp the pieces 102, 104 as shown in FIG. 9, projections or tabs (not shown) could be added at that end of the pieces 102, 104 to provide more pronounced bearing surfaces for the forceps.

The foregoing disclosure and description of the invention are illustrative and explanatory of the invention, and various changes in the size, shape and materials, as well as in the details of the illustrated construction and process may be made without departing from the spirit of the invention, all of which are contemplated as falling within the scope of the appended claims.

We claim:

1. A magnet assembly for coupling with the magnetic coil of a hearing said, comprising:

a first separate section sized and shaped to partially surround at least a portion of a bone in the ossicular chain;

a second separate section sized and shaped to cooperate with the first section and clamp onto said portion of a bone in the ossicular chain, at least one of the first and second sections comprising a magnet and the other section formed of material that is magnetically attracted to the magnet.

2. The magnet assembly of claim 1, further comprising:

hinge means for connecting said first and second sections, said hinge means contacting said first and second sections so that a portion of each section is on both sides of the pivot point of said hinge means;

the sections being shaped and dimensioned so that force applied to outer surfaces of each section in the direction of the other section on one side of said pivot point will cause the portion of each section on the other side of said pivot point to move apart, removal of the force allowing said section portions to move together and clamp onto a portion of a bone in the ossicular chain because of the magnetic attraction of said sections.

3. The magnet assembly of claim 2, wherein one section is formed of a magnet and the other section of magnetically attracted material.

4. The magnet assembly of claim 2, wherein both sections are magnets with poles located so that they attract each other.

5. The magnet assembly of claim 2, wherein both sections are coated with a biocompatible polymer.

6. The magnet assembly of claim 2, wherein said hinge means includes one section having a fulcrum and the other section having a fulcrum groove for receiving the fulcrum.

7. The magnet assembly of claim 2, wherein first and second pieces include opposing faces and hollowed-out portions designed to engage the incus.

* * * * *